US005669702A

United States Patent [19]

Wang

[11] Patent Number: 5,669,702

[45] Date of Patent: Sep. 23, 1997

[54] INFLATABLE ARTICLE WITH AN ILLUMINATING DEVICE

[76] Inventor: Wen-Ching Wang, No. 15, Fu-Chia Lane, Chen-Nan Rd.,, Sa-Lu Chen, Taichung Hsien, Taiwan

[21] Appl. No.: 732,172

[22] Filed: Oct. 16, 1996

Related U.S. Application Data

[63] Continuation-in-part of Ser. No. 660,577, Jun. 11, 1996, Pat. No. 5,609,411.

[51] Int. Cl.[6] ..... F21V 33/00

[52] U.S. Cl. ..... 362/234; 362/253; 362/363; 362/96; 446/439; 446/485

[58] Field of Search ..... 362/62, 96, 234, 362/253, 251, 186, 353, 363, 806, 809, 800; 273/65 EF, 58 G; 446/439, 485

[56] References Cited

U.S. PATENT DOCUMENTS

| | | | |
|---|---|---|---|
| 4,542,445 | 9/1985 | Marletta | 362/96 |
| 4,997,403 | 3/1991 | Akman | 362/96 X |
| 5,066,012 | 11/1991 | Stark | 362/253 X |

*Primary Examiner*—Stephen F. Husar
*Attorney, Agent, or Firm*—Baker & Botts, L.L.P.

[57] ABSTRACT

An inflatable article includes a rounded wall that encloses a first space. An illuminating device is mounted inside the rounded wall and occupies a portion of the first space. The device includes a base bonded sealingly and integrally to the rounded wall. The base confines a second space hermetically sealed from a remaining portion of the first space, and has a part exposed from the rounded wall and an opening for access to the second space. A light emitting element is disposed interiorly of the opening. A power source has a negative electrode proximate to the opening and a positive electrode connected to a first terminal of the light emitting element. A conductive member extends axially and outwardly of the power source and is connected to a second terminal of the light emitting element. A conductive cap closes the opening and is movable between a conducting position and a non-conducting position. At the conducting position, the cap engages an upper end of the conductive member to activate the emitting element. At the non-conducting position, the cap is spaced apart from the upper end of the conductive member so as to deactivate the light emitting element.

6 Claims, 4 Drawing Sheets

INFLATABLE ARTICLE WITH AN ILLUMINATING DEVICE

CROSS-REFERENCE OF RELATED APPLICATION

This invention is a Continuation-in-part (CIP) application of U.S. Pat. Appln. Ser. No. 08/660,577, which was filed on Jun. 11, 1996now U.S. Pat. No. 5,609,141.

BACKGROUND OF THE INVENTION

1. Field of the Invention

The invention relates to an article which incorporates an illuminating device, more particularly to an inflatable article, such as a ball or the like, which has an illuminating device.

2. Description of the Related art In U. S. Pat. Appln. Ser. No. 08/660,577, now U.S. Pat. No. 5,609,141 the applicant disclosed an inflatable article which includes a gas-tight hollow body and an illuminating device. The gas-tight hollow body has a rounded wall which encloses a first space. The illuminating device is mounted inside the hollow body and occupies a portion of the first space. The illuminating device includes containing means with a base bonded sealingly and integrally to the rounded wall. The containing means confines a second space hermetically sealed from a remaining portion of the first space. The base has at least a part exposed from the rounded wall and an opening formed in the part for access to the second space. The illuminating device further includes electric circuit means which is received in the second space, and which has a light emitting element and a power source. A cap is mounted removably for closing the opening in the base of the containing means. The electric circuit means further includes a switch for energizing the same in response to movement of the gas-tight hollow body.

Because the switch is responsive to every movement of the rounded wall, the power source in the aforementioned inflatable article should be removed from the rounded wall during daytime in order to prolong the service life of the power source. The cap must be removed from the rounded wall prior to removing the power source from the rounded wall. This annoys the user of the inflatable article.

SUMMARY OF THE INVENTION

The object of this invention is to provide an inflatable article which includes a cap unit and a power source receptacle unit which are disposed in the rounded wall and which can dispose selectively the illuminating device at an ON or OFF condition without the need for removing the power source from the rounded wall.

The inflatable article of this invention includes a gas-tight hollow body and an illuminating device. The gas-tight hollow body has a rounded wall which encloses a first space. The illuminating device is mounted inside the rounded wall and occupies a portion of the first space. The illuminating device includes containing means with a base bonded sealingly and integrally to the rounded wall so as to confine a second space hermetically sealed from a remaining portion of the first space. The base has at least a part exposed from the rounded wall and an opening for access to the second space. The containing means includes a primary mounting seat which is formed integrally with the base and which has an inner wall that defines a cavity therethrough in communication with the opening, and an annular groove that is formed in the inner wall. The containing means further includes a tubular secondary mounting seat which is disposed in the cavity and which has an annular outward flange press-fitted into the annular groove of the primary mounting seat so as to form a first gas-tight seal between the primary and secondary mounting seats. The illuminating device further has electric circuit means which is received in the second space and which includes a light emitting element disposed interiorly of the opening and formed with a first electric terminal and a second electric terminal. A power source is disposed between the opening and the light emitting element and has a negative electrode proximate to the opening and a positive electrode in electrical contact with the first electric terminal of the light emitting element. A conductive member extends axially and outwardly of the power source. The conductive member has a lower end connected to the second electric terminal of the light emitting element and an upper end disposed so as to be more proximate to the opening than the negative electrode. A conductive cap closes the opening of the base and is movable axially relative to the primary mounting seat between a conducting position and a non-conducting position. A conductive biasing member is disposed between the cap and the negative electrode of the power source such that, when the conductive cap is at the conductive position, the cap engages the upper end of the conductive member against biasing action of the biasing member. When the conductive cap is at the non-conducting position, the cap is spaced apart from the upper end of the conductive member so as to deactivate the light emitting element.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
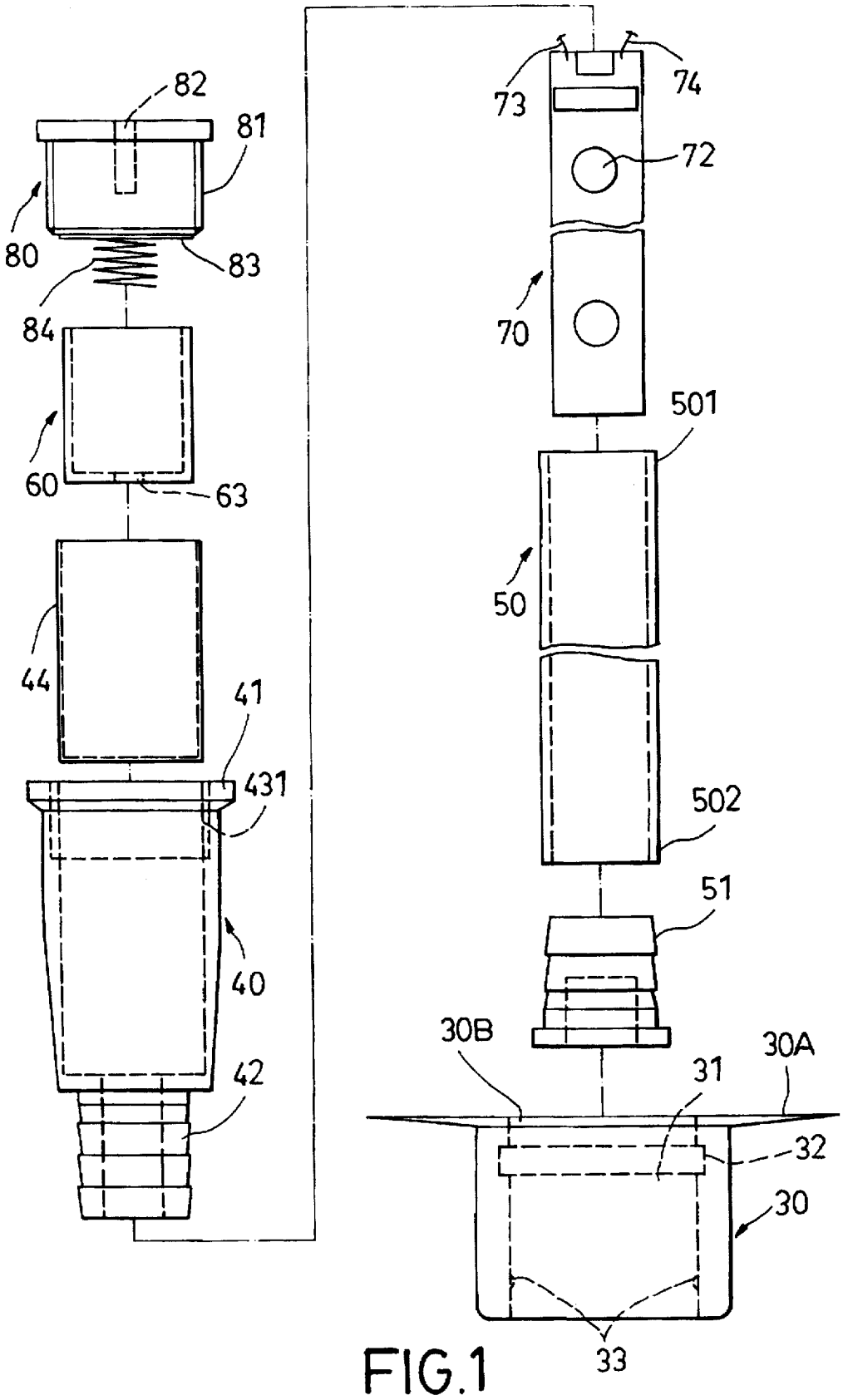
FIG. 1 is an exploded view of an illuminating device employed in an inflatable article of this invention.

Before the present invention is described in greater detail, it should be noted that same reference numerals have been used to denote like elements throughout the disclosure. The first preferred embodiment of an inflatable article according to this invention includes a gas-tight hollow body and an illuminating device.

Figure 2:
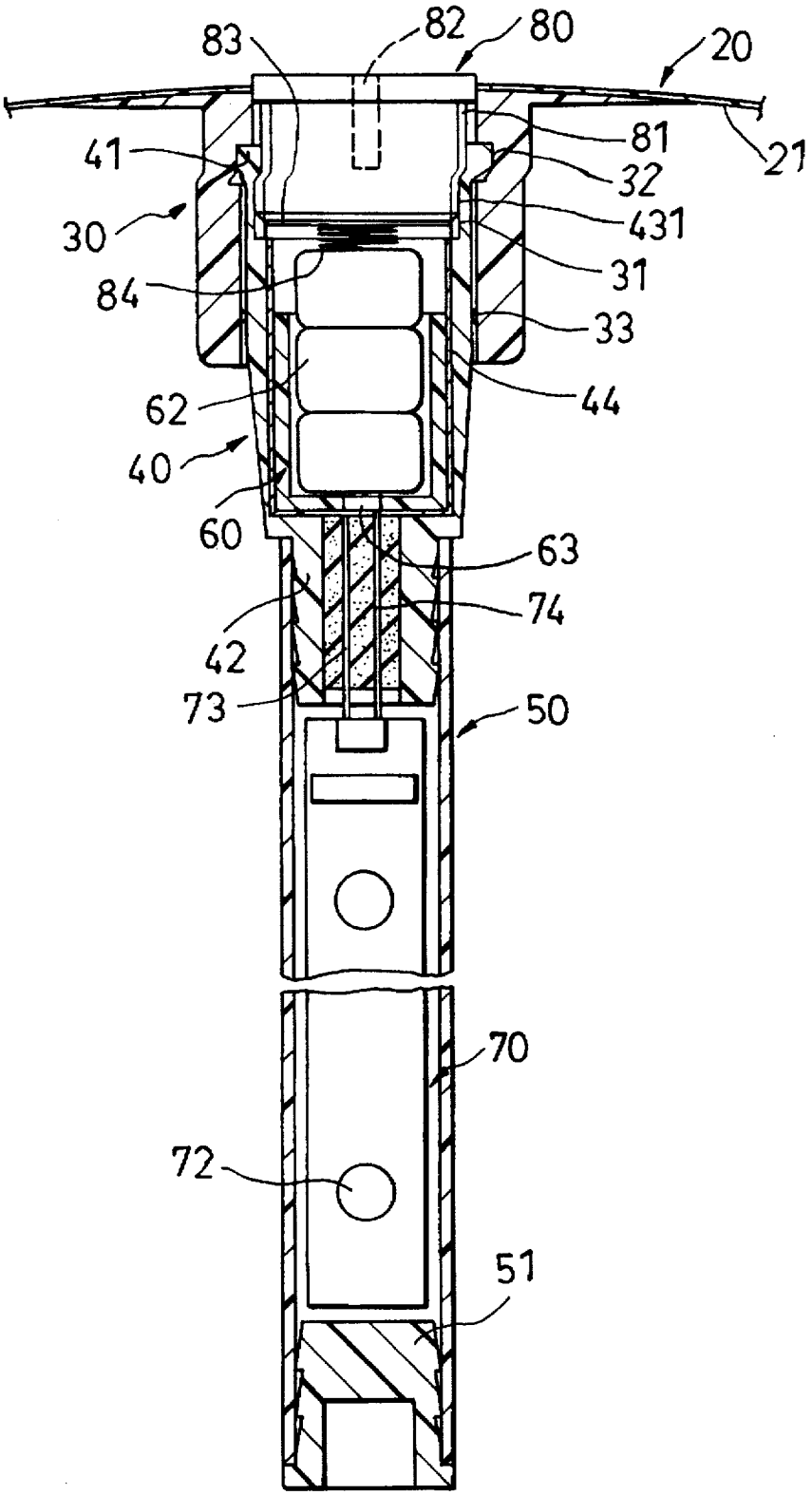
FIG. 2 is a fragmentary sectional view of the inflatable article of this invention, illustrating the illuminating device when in a deactivate state.
Figure 3:
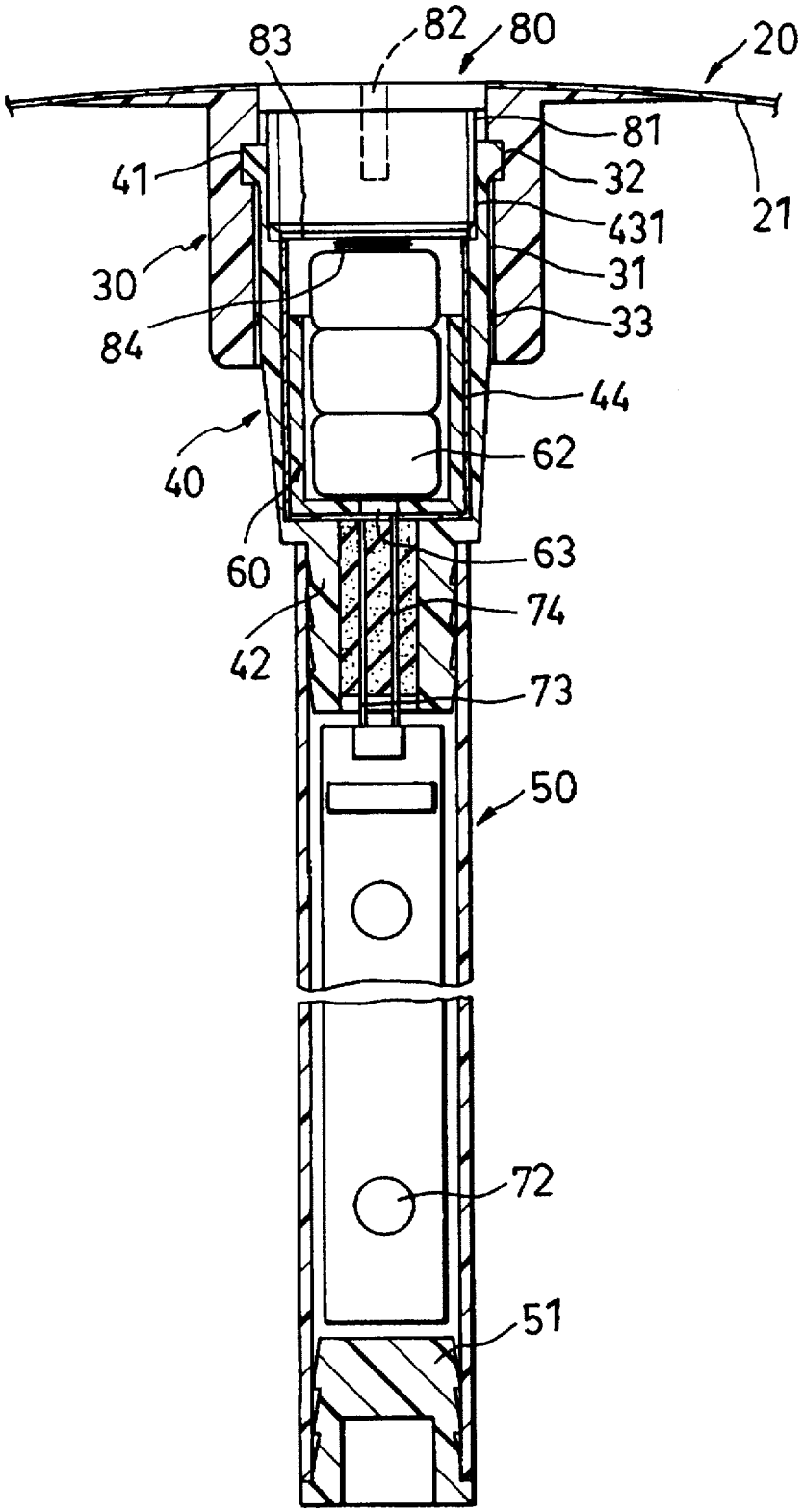
FIG. 3 is a fragmentary sectional view of the inflatable article of this invention, illustrating the illuminating device when in an activated state.

As illustrated in FIGS. 1, 2 and 3, the gas-tight hollow body has a rounded wall 20 of a rubber material which encloses a first space 21 therein. The illuminating device is mounted inside the rounded wall 20 and occupies a portion of the first space 21. The illuminating device includes containing means which confines a second space hermetically sealed from a remaining portion of the first space 21, and electric circuit means 70 received in the second space. The containing means includes a hollow primary mounting seat 30, a generally tubular secondary mounting seat 40, an insulative receptacle 60, a transparent light housing 50, and an inner seal 51.

The primary mounting seat 30 is made of a rubber material and has a base 30A bonded sealingly and integrally to the rounded wall 20. A part of the base 30A is exposed from the rounded wall 20 and has an opening 30B formed therein for access into the second space. The primary mounting seat 30 has an inner wall that defines a cavity 31 therethrough in communication with the opening 30B, and an annular groove 32 formed in the inner wall. The secondary mounting seat 40 is disposed in the cavity 31 of the primary mounting seat 30 and has a converging outer wall and an annular outward flange 41 press-fitted into the annular groove 32 so as to form a first gas-tight seal between the primary and secondary mounting seats 30, 40.

A conductive member 44, in the form of a tubular sleeve, is disposed in the secondary mounting seat 40 and has an upper end disposed adjacent to the opening 30B of the primary mounting seat 30.

The insulative receptacle 60 is disposed in the secondary mounting seat 40 and is in the form of a hollow tube. The insulative receptacle 60 has an axial hole 63 formed through a lower portion thereof, and an axial length shorter than that of the conductive member 44. The plastic light housing 50 can be passed through the opening 30B and the cavity 31 of the primary mounting seat 30 and through the secondary mounting seat 40. An inner seal 51 is coupled sealingly to a second open end 502 of the light housing 50 so as to receive the electric circuit means 70 therein. A first open end 501 of the light housing 50 is coupled sealingly to a lower portion 42 of the secondary mounting seat 40.

The power source 62, such as mercury cells, is disposed in the receptacle 60 in such a manner that a negative electrode of the power source 62 is proximate to the opening 30B while a positive electrode of the power source 62 extends through the axial hole 63 of the insulative receptacle 60 to connect with the first electric terminal 74 of the electric circuit means 70. The second electric terminal 73 of the electric circuit means 70 is in electrical connection with the conductive member 44. In this embodiment the electric circuit means 70 includes an integrated circuit board with a plurality of light emitting elements 72 fixed thereon. Under this condition, the insulative receptacle 60 prevents formation of an electrical connection between the power source 62 and the conductive member 44.

The cap 80 includes external threads 81 which engage the internal threads 431 of the secondary mounting seat 40. A conductive biasing member 84 is disposed between the cap 80 and the negative electrode of the power source 62. The cap 80 is movable axially relative to the primary mounting seat 30 between a conducting position and a non-conducting position. As best shown in FIG. 2, when the cap 80 is at the non-conducting position, the cap 80 is spaced apart from the upper end of the conductive member 44 so as to deactivate the light emitting elements 72. As illustrated in FIG. 3, when desired, the cap 80 can be threaded further into the secondary mounting seat 40 against biasing action of the biasing member 84 so as to dispose the cap 80 at the conducting position. At this time, a conductive pad 83 on the cap 80 engages the upper end of the conductive member 44, thereby forming an electrical connection between the first and second electric terminals 74, 73 of the light emitting element 72 so as to activate the latter. The cap 60 is provided with a straight slot 82 to facilitate turning of the same.

Note that the primary mounting seat 30 further has an annular inward projection 33 that abuts sealingly against the converging outer wall of the secondary mounting seat 40, thereby forming a second gas-tight seal between the primary and secondary mounting seats 30, 40.

Figure 4:
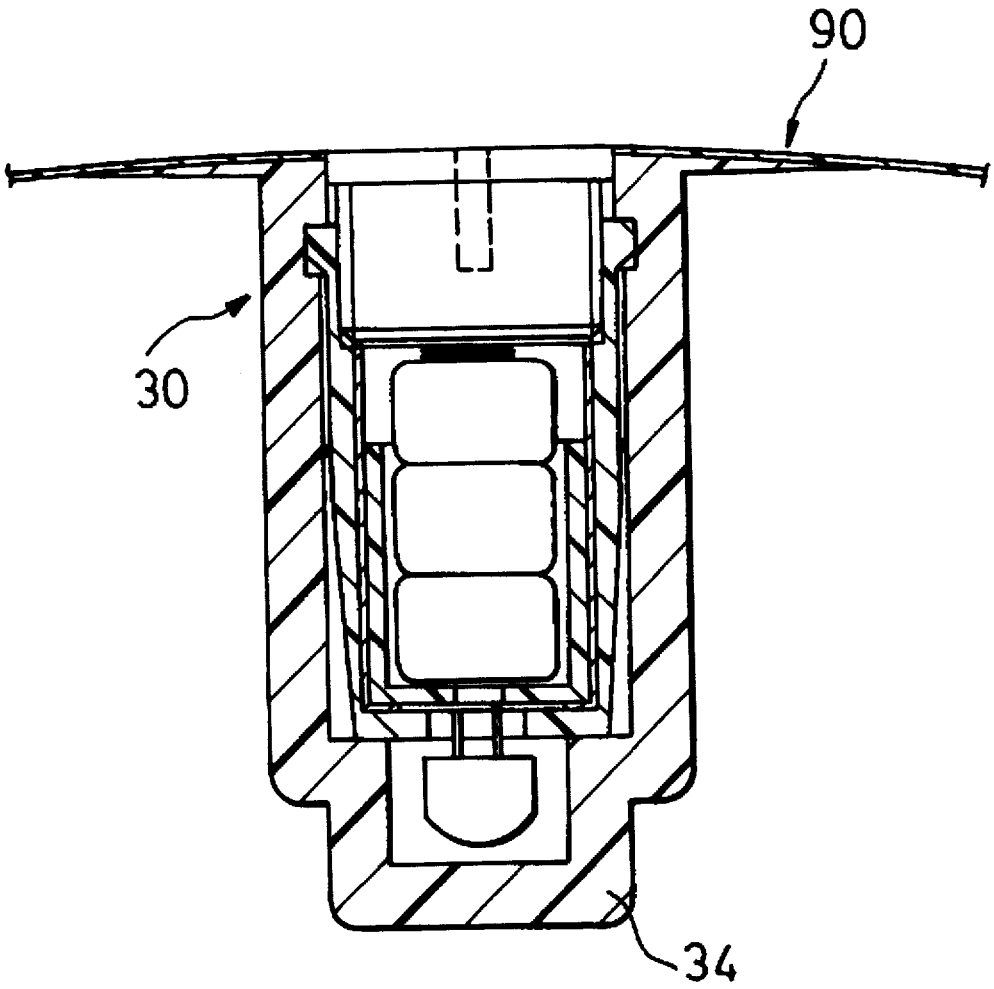
FIG. 4 is a fragmentary sectional view of a modified inflatable article of this invention.

Referring to FIG. 4, a second preferred embodiment 90 of the inflatable article of this invention is shown to be generally similar to the previous embodiment. The transparent light housing 34 of the second embodiment, however, has a closed lower end and an upper open end coupled sealingly and integrally to a lower portion of the primary mounting seat 30.

With this invention thus explained, it is apparent that numerous modifications and variations can be made without departing from the scope and spirit of this invention. It is therefore intended that this invention be limited only as indicated in the appended claims.

I claim:

1. An inflatable article comprising:

a gas-tight hollow body having a rounded wall which encloses a first space;

an illuminating device mounted inside said hollow body and occupying a portion of said first space, said illuminating device including containing means which has a base bonded sealingly and integrally to said rounded wall and which confines a second space hermetically sealed from a remaining portion of said first space, said base having at least a part exposed from said rounded wall and an opening formed in said part for access to said second space, said containing means further including a primary mounting seat which is formed integrally with said base and which has an inner wall that defines a cavity therethrough in communication with said opening and an annular groove formed in said inner wall, said containing means further including a tubular secondary mounting seat disposed in said cavity and having an annular outward flange press-fitted into said annular groove of said primary mounting seat so as to form a first gas-tight seal between said primary and secondary mounting seats, wherein said illuminating device further has electric circuit means which is received in said second space and which includes: a light emitting element disposed interiorly of said opening and formed with a first electric terminal and a second electric terminal; a power source disposed between said opening and said light emitting element and having a negative electrode proximate to said opening and a positive electrode in electrical contact with said first electric terminal of said light emitting element; and a conductive member extending axially and outwardly of said power source and having a lower end connected to said second electric terminal of said light emitting element and an upper end disposed to be more proximate to said opening than said negative electrode;

a conductive cap closing said opening and movable axially relative to said primary mounting seat between a conducting position and a non-conducting position; and a conductive biasing member disposed between said cap and said negative electrode such that, when said conductive cap is in said conducting position, said cap engages said upper end of said conductive member against biasing action of said biasing member, and when said cap is in said non-conducting position, said cap is spaced apart from said upper end of said conductive member so as to deactivate said light emitting element.

2. The inflatable article as defined in claim 1, wherein said conductive member is formed as a tubular sleeve, said containing means further including an insulative tubular receptacle sleeved on said power source so as to insulate said conductive member from said power source, thereby preventing formation of an electrical connection between said power source and said conductive member, said insulative receptacle having an axial hole formed through a lower portion thereof for passage of said positive electrode of said power source.

3. The inflatable article as defined in claim 1, wherein said secondary mounting seat has a converging outer wall, said primary mounting seat further having an annular inward projection abutting against said converging outer wall, thereby forming a second gas-tight seal between said primary and secondary mounting seats.

4. The inflatable article as defined in claim 1, wherein said containing means further includes a transparent light housing which receives said light emitting element therein and which has a first open end coupled sealingly to a lower portion of said secondary mounting seat, and an inner seal coupled sealingly to a second open end of said light housing, said light housing being made of plastic and being capable of passing through said opening and said cavity of said primary mounting seat and through said secondary mounting seat.

5. The inflatable article as defined in claim 1, wherein said illuminating device further includes a transparent light housing which receives said light emitting element therein and which has a closed lower end and an upper open end coupled sealingly and integrally to a lower portion of said primary mounting seat.

6. The inflatable article as claimed in claim 1, wherein said primary and secondary mounting seats are transparent.

* * * * *